US007131857B2

(12) United States Patent
Mueller

(10) Patent No.: US 7,131,857 B2
(45) Date of Patent: Nov. 7, 2006

(54) ELECTRICAL PLUG, HOLDER, SYSTEM HAVING AN ELECTRICAL PLUG AND A HOLDER, AND METHOD OF MAKING A CONNECTION BETWEEN AN ELECTRICAL PLUG AND A HOLDER

(75) Inventor: Manfred Mueller, Huettenberg (DE)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/985,649

(22) Filed: Nov. 11, 2004

(65) Prior Publication Data

US 2005/0112915 A1 May 26, 2005

(30) Foreign Application Priority Data

Nov. 14, 2003 (DE) ..... 103 53 356

(51) Int. Cl.
*H01R 11/20* (2006.01)
*H01R 4/26* (2006.01)

(52) U.S. Cl. ..... 439/441; 439/835

(58) Field of Classification Search ..... 439/835, 439/441, 829, 912, 76.1
See application file for complete search history.

(56) References Cited

U.S. PATENT DOCUMENTS

| | | | | |
|---|---|---|---|---|
| 4,087,149 A | | 5/1978 | Fischer | |
| 4,768,981 A | | 9/1988 | Hohorst | 439/835 |
| 6,004,168 A | * | 12/1999 | Fuchs et al. | 439/835 |
| 6,074,241 A | * | 6/2000 | Patel et al. | 439/441 |
| 6,155,890 A | | 12/2000 | Gerberding | 439/835 |
| 6,283,801 B1 | * | 9/2001 | Guinda et al. | 439/835 |
| 6,464,545 B1 | * | 10/2002 | Yano | 439/828 |
| 6,736,683 B1 | * | 5/2004 | Brand et al. | 439/828 |

FOREIGN PATENT DOCUMENTS

| | | |
|---|---|---|
| DE | 1246079 | 8/1967 |
| DE | 3514099 | 10/1986 |
| DE | 3817706 | 12/1988 |
| DE | 3911459 | 10/1990 |
| DE | 19629445 | 2/1997 |
| DE | 19715971 | 5/1998 |
| DE | 19802945 | 7/1999 |
| DE | 19817925 | 10/1999 |
| EP | 0108235 | 5/1984 |

* cited by examiner

*Primary Examiner*—Michael C. Zarroli
(74) *Attorney, Agent, or Firm*—Harness, Dickey & Pierce, P.L.C.

(57) ABSTRACT

An electrical plug includes a housing and a spring clamp to connect a flexible electric conductor to an end piece of a rigid holder. The clamp spring includes a contact leg and a clamp leg. The clamp leg is bent closed in a loop onto the contact leg end providing a clamp opening through which the contact leg end protrudes. The clamp leg and a clamp opening edge positioned opposite to the clamp leg form a clamp location in which the electric conductor passed through the clamp opening is clamped before mounting the plug on the holder. After mounting, the holder extends through the clamp opening displacing the contact leg from the electric conductor. The holder and clamp spring clamp the electric conductor and form an electrical connection between the holder and electric conductor.

33 Claims, 3 Drawing Sheets

ELECTRICAL PLUG, HOLDER, SYSTEM HAVING AN ELECTRICAL PLUG AND A HOLDER, AND METHOD OF MAKING A CONNECTION BETWEEN AN ELECTRICAL PLUG AND A HOLDER

CROSS-REFERENCE TO RELATED APPLICATIONS

This application claims the benefit of German Patent Application No. 10353356.7, filed Nov. 14, 2003. The disclosure of the above application is incorporated herein by reference.

FIELD OF THE INVENTION

The invention relates to an electrical plug having a housing and a spring clamp connection for connecting a flexible electric conductor to the end piece of a rigid holder. The invention relates further to such a holder, to a suitable system consisting of an electrical plug and a holder, and to a method of making a connection between an electrical plug and a holder.

BACKGROUND OF THE INVENTION

There are known connecting clamps having a housing and a spring clamp connection for connecting a flexible electric conductor to current rails, where the spring clamp connection consists of a clamp spring made of flat spring material. The connecting clamps disclosed for example in printed sources DE 3,514,099 C2, DE 198 02 945 A1 or DE 198 17 925 A1 comprise a contact leg and a clamp leg, the clamp leg being bent closed in the manner of a loop onto the end of the contact leg and comprising a clamp opening to which the end of the contact leg extends through. Such connecting clamps are employed to connect a flexible conductor to a current rail already connected to the spring clamp junction, where the flexible conductor is not introduced into the spring clamp connection until after the connection with the rigid current rail has been made.

SUMMARY OF THE INVENTION

The object of the invention is to create an electrical connection between a flexible electric conductor and a rigid holder by means of a plug, the plug being first connected to the electric conductor and then to the rigid holder. Such a connection is required for example for the junction of a ground cable to a ground holder of the chassis of a motor vehicle. The object consisted further in that mounting of the plug provided with the electric conductor on the holder might be done quickly and without tools, and in that a securely realizable snap-click assembly would be possible. Further, the smallest possible transition resistances are to be achieved.

This object is accomplished, according to the invention, by creating an electrical plug having a housing in which a spring clamp connection serves to join a flexible electric conductor to the end piece of a rigid holder, said spring clamp connection consisting of a clamp spring made of flat spring material, having a contact leg and a clamp leg, the clamp leg being bent closed in the manner of a loop onto the end of the contact leg and comprising a clamp opening through which the end of the contact leg extends through, where a clamp edge of the clamp opening opposed to the clamp leg forming a clamp location with the contact leg in which the electric conductor passed through the clamp opening is fixed before the plug is mounted on the holder, and after mounting of the plug on the holder, the holder extends between the contact leg and the electric conductor through the clamp opening, and the holder and the clamp spring are so braced on one another that the electric conductor is clamped between the clamp edge and the holder, thus forming an electrical connection between holder and electric conductor.

The object is accomplished further, according to the invention, by a holder and a system consisting of a suitable electrical plug and a suitable holder, where the rigid holder takes the form of a pin and is made out of strip material of substantially rectangular cross-section. A crook (21) is arranged on the holder, the vertex pointing towards the clamp edge of the clamp leg to avoid a reversed mounting of the plug on the holder.

The method of making a connection between the suitable electrical plug and the holder, whereby the object is accomplished, includes the feature that after the electric conductor has been clamped firmly between clamp edge and contact leg, the plug is so mounted on the holder that the holder extends between the contact leg and the electric conductor through the clamp opening, and the holder and the clamp spring are so braced against each other that the electric conductor is clamped between the clamp edge and the holder, thus forming an electrical connection between the holder and the electric conductor.

By the measures set forth in the dependent claims, advantageous refinements and improvements of the electrical plug specified in the independent claims, of the system consisting of electrical plug and holder, and of the method of making a connection between an electrical plug and a holder, are made possible. It is especially advantageous to configure the contact leg with a crook directed towards the clamp edge of the clamp opening and arranged at the clamp location. Owing to the small areas of contact of the contact leg at the clamp location, this provides a secure connection between the electric conductor and the holder.

It is advantageous, further, to bend the end of the flat spring material opposed to the clamp location towards the holder in such manner that after the plug has been mounted on the holder, it will catch in or engage a recess in the holder. In this way, the security of the connection is improved as well, since when the holder has been thrust all the way into the plug, the engagement of the bent end of the flat spring material in the recess of the holder takes place. Therefore, it is not possible for the holder to pull out of the plug without anything more. It is likewise of advantage to provide the flat spring material with an opening for release of the plug, where upon insertion of an auxiliary means, for example a pin, through this opening, the end of the flat spring material opposed to the clamping location is bent up, so that the bent-over end of the flat spring material no longer engages the recess of the holder, and the plug can be drawn off from the holder. It is advantageous further to provide the end located opposed to the clamp location with wing elements serving to position the holder in relation to the clamp spring. The electrical plug further comprises advantageous wing elements arranged on the flat spring material and fixing the clamp spring in a recess of the housing.

To seal the housing from environmental influences, it is advantageous to provide the openings through which the electric conductor and/or the holder are inserted with sealing lips. For the holder, it is advantageous if, for use of the plug to produce a contact between ground cable and chassis of a motor vehicle, the holder is welded onto the chassis.

For engagement of the bent-over end of the spring element in the holder, advantageously a recess is provided on the holder. It is especially advantageous if this recess pierces the holder in the manner of an opening, so that an auxiliary means can be passed through it that bends the end of the flat spring material opposed to the clamp location outward in such manner that the bent-over end slips out of the opening and the holder can be pulled out of the plug.

BRIEF DESCRIPTION OF THE DRAWINGS

Embodiments of the invention are represented by way of example in drawings and further illustrated in the description below. In the drawings.

DETAILED DESCRIPTION

Figure 1A:
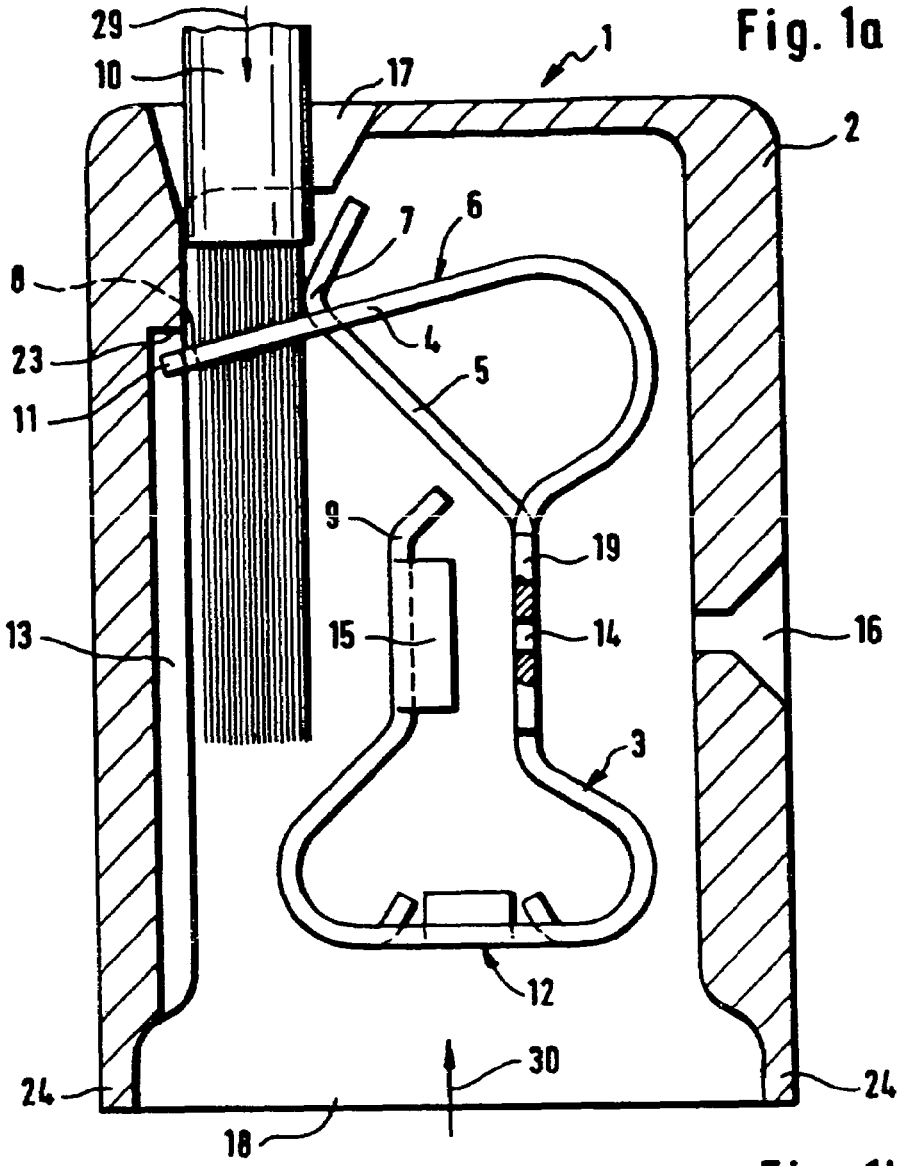
FIG. 1 shows a plug according to the invention with flexible electric conductor ready inserted, in longitudinal section and in bottom view.

FIG. 1*a* shows a longitudinal section of a plug 1 according to the invention. The plug 1 comprises a housing 2 in which a clamp spring 3 made of a flat spring material is arranged. The clamp spring 3 forms a spring clamp connection for connecting a flexible electric conductor 10 to the end piece of a rigid holder not shown in this figure.

The clamp spring 3 comprises a clamp leg 4 and a contact leg 5, the contact leg 5 being stamped out of the flat spring material in the shape of a tongue and so bent away that the contact leg 5 extends through the clamp opening 6 of the clamp leg 4 formed by the punched-out tongue. The clamp leg 4 is bent over to the rear and bent closed again in the form of a loop onto the contact leg 5. The edge 8 of the clamp opening located opposed to the bent edge of the contact leg 5 is also referred to as a clamp edge, since this edge together with the crooked portion 7 of the contact leg 5 forms the clamp location.

The electrical plug 1 pictured in FIG. 1*a* is prepared for placement on the rigid holder with flexible electric conductor 10 ready inserted. For this purpose, the end of the electric conductor 10 is passed through the opening 17 at the top of the housing 2 in a direction indicated by an arrow 29, through the clamp opening 6, and clamped between clamp edge 8 and crooked portion of contact leg 5. The housing 2, at the opposed end, comprises an opening 18 through which the holder is passed when fastening the plug. For insertion of the holder through the clamp spring, an opening 12 is provided on the flat spring material, comprising ends bent inward for better support of the holder. The housing 2 is provided laterally with yet another opening 16 through which an auxiliary means, for example a pin or a screw driver, can be passed, to release the connection between holder and clamp spring 3. For release of the holder, the clamp spring 3 is also provided with an opening 14, through which this auxiliary means is likewise inserted when opening the connection. At the end of the flat spring material opposed to the clamp location, the clamp spring 3 comprises a bent-over end 9 that engages a recess of the holder when the holder is pushed all the way in.

For better positioning of the holder in the clamp spring 3, wings 15 are provided at this end. To protect the interior of the plug from environmental influences, the plug comprises sealing lips 24 at the end at which the holder is introduced. Sealing lips may be provided as well at the opening 17 through which the electric conductor 10 is introduced. In FIG. 1*a*, further, an arrow 30 indicates the direction in which the holder is introduced into the housing 2 through the opening 18.

Figure 1B:
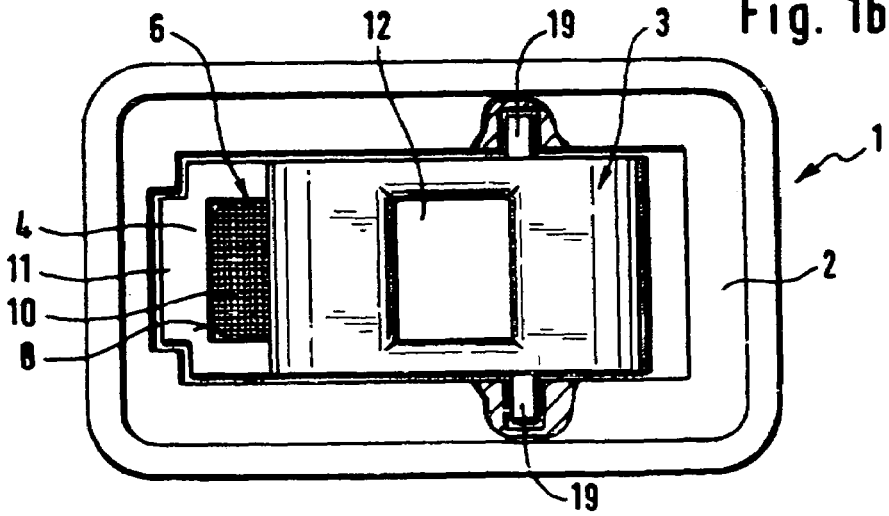

In FIG. 1*b*, the plug according to the invention is shown in a bottom view, where, much as in FIG. 1*a*, the flexible electric conductor 10 has been inserted in the plug. In the cut-up portions of this representation, it may be seen that the clamp spring 3 is so arranged in the housing 2 that wing elements 19 engage recesses in the housing 2, and thus fix the clamp spring 3 in the housing 2. Likewise more clearly apparent is the opening 12 in the flat spring material 33, through which the holder is passed into the clamp spring 3 when mounting the plug 1 on the holder. Likewise apparent is the end of the electric conductor 10 arranged in the clamp opening 6. The flexible electric conductor 10 thus rests against the clamp edge 8 formed by punching the contact leg 5 out of the clamp leg 4. It is shown also that the foremost end of the clamp leg 4 is provided with a projection 11, engaging a recess in the housing 2. In FIG. 1*a*, it may be seen that to prevent the clamp leg from deflecting too far towards the opening 17 for insertion of the flexible electric conductor 10, the recess 13 in the housing 2 comprises a stop 23 limiting the motion of the clamp leg 4.

Figure 2:
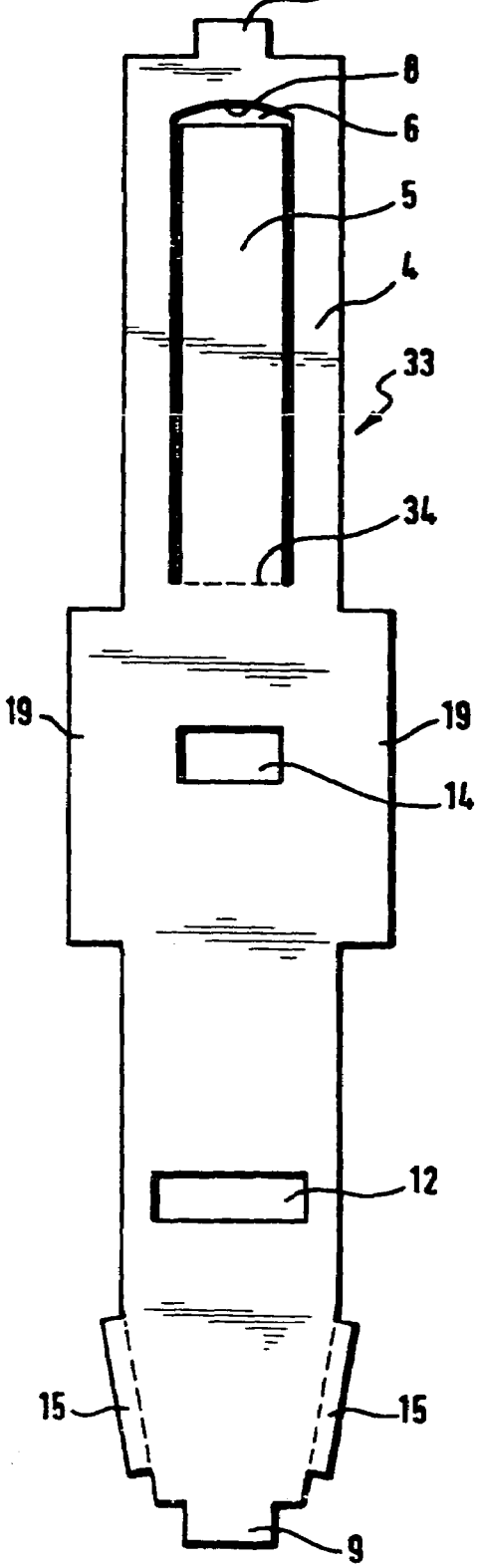
FIG. 2 shows the flat spring material serving for production of a plug according to the invention.

FIG. 2 shows the flat spring material serving to produce the clamp spring 3 for the electrical plug according to the invention. The flat spring material, in the state shown in FIG. 2, is so prepared that after bending of the flat material, the clamp spring 3 has been completed. The flat spring material comprises the contact leg 5 punched out of the clamp leg 4 in the shape of a tongue, the clamp opening 6 being formed after the contact leg 5 is bent over. The edge 8 of the clamp opening 6, opposed to the edge 34, shown dotted, to be bent over, serves to form the clamp location after installation of the clamp spring 3 in the housing 2. More or less centrally to the flat spring material, the opening 14 is arranged, serving to release the connection between holder and plug 1. From there towards the end opposed to the clamp location, the opening 12 is arranged, through which the holder is passed when mounting the plug 1 on the holder. At the end of the flat spring material opposed to the clamp location, wing elements 15 are arranged, serving to position the holder in the clamp spring. A projection 9 arranged at the end of the flat spring material opposed to the clamp location is additionally bent over to complete the clamp spring 3, so that the holder, when it has been thrust all the way into the plug 1, becomes engaged, the bent-over end 9 of the flat spring material engaging a recess of the holder.

Figure 3:
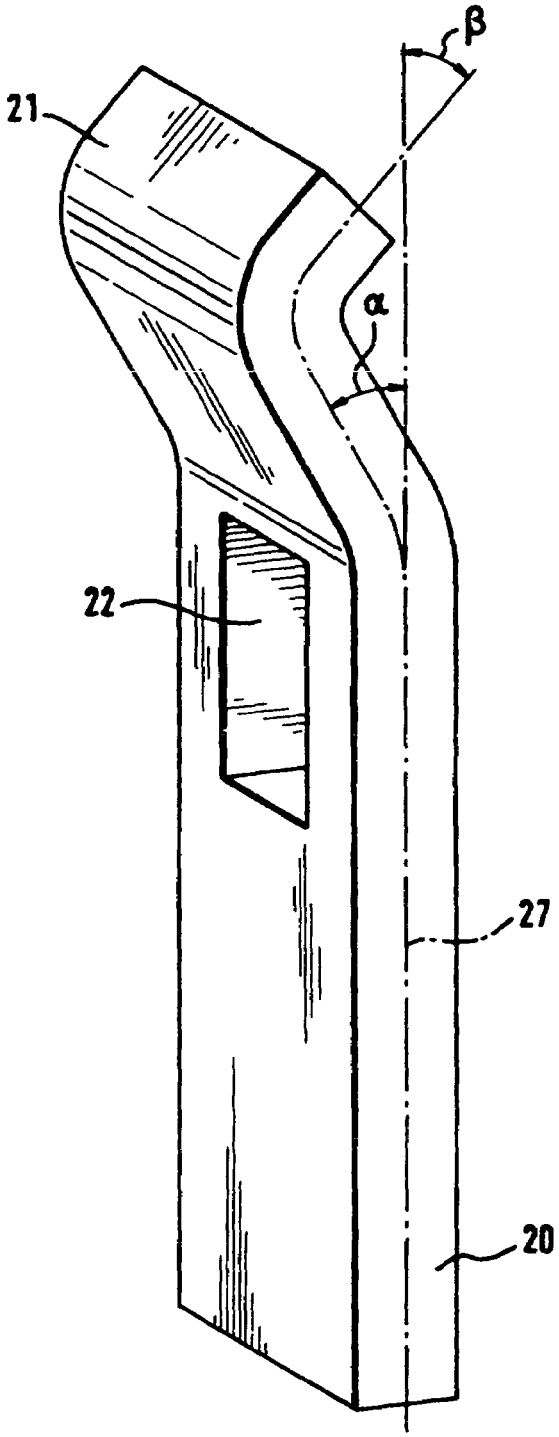
FIG. 3 shows a side view of a holder according to the invention.

FIG. 3 shows a side view of a holder 20 according to the invention. The holder 20, made of a rigid material, consists of a strip rectangular in cross section, a through opening or hole 22 being arranged more or less centrally, to be engaged by the projection 9 of the flat spring material of the clamp spring when the plug is thrust onto the holder. The holder comprises two bends above the through opening 22, the bending having taken place in opposed direction. At the bends arranged directly above the opening 22, the holder at first angles away from the holder axis 27 at an angle $\alpha$. The bending of the holder above the opening 22 takes place in the direction in which the electric conductor 10, or the clamp edge 8, is arranged after mounting of the plug. At the bend 21 above, the strip material is bent back in the opposed direction by an angle $\alpha$ plus $\beta$, so that the strip material makes an angle $\beta$ with the axis 27, the angle $\beta$ being measured from the axis 27 in the opposed direction compared to the direction of measurement of the angle α from the same axis. In the following, the bend 21 will also be referred to as a crook. Therefore the two legs of the crook 21 enclose an angle of 180°—(α+β). The angles α and β are preferably acute, the sum α+β not exceeding 90°. With the crook 21, the holder, in the state in which the plug is completely mounted on the holder, is in contact with the electric conductor 10, and forms the electrical connection with the conductor 10. The two bends of the holder, in particular the crook 21, thus form sliding surfaces for mounting of the plug on the holder. The crook 21 forms contact surfaces for the electrical connection as well.

Figure 4:
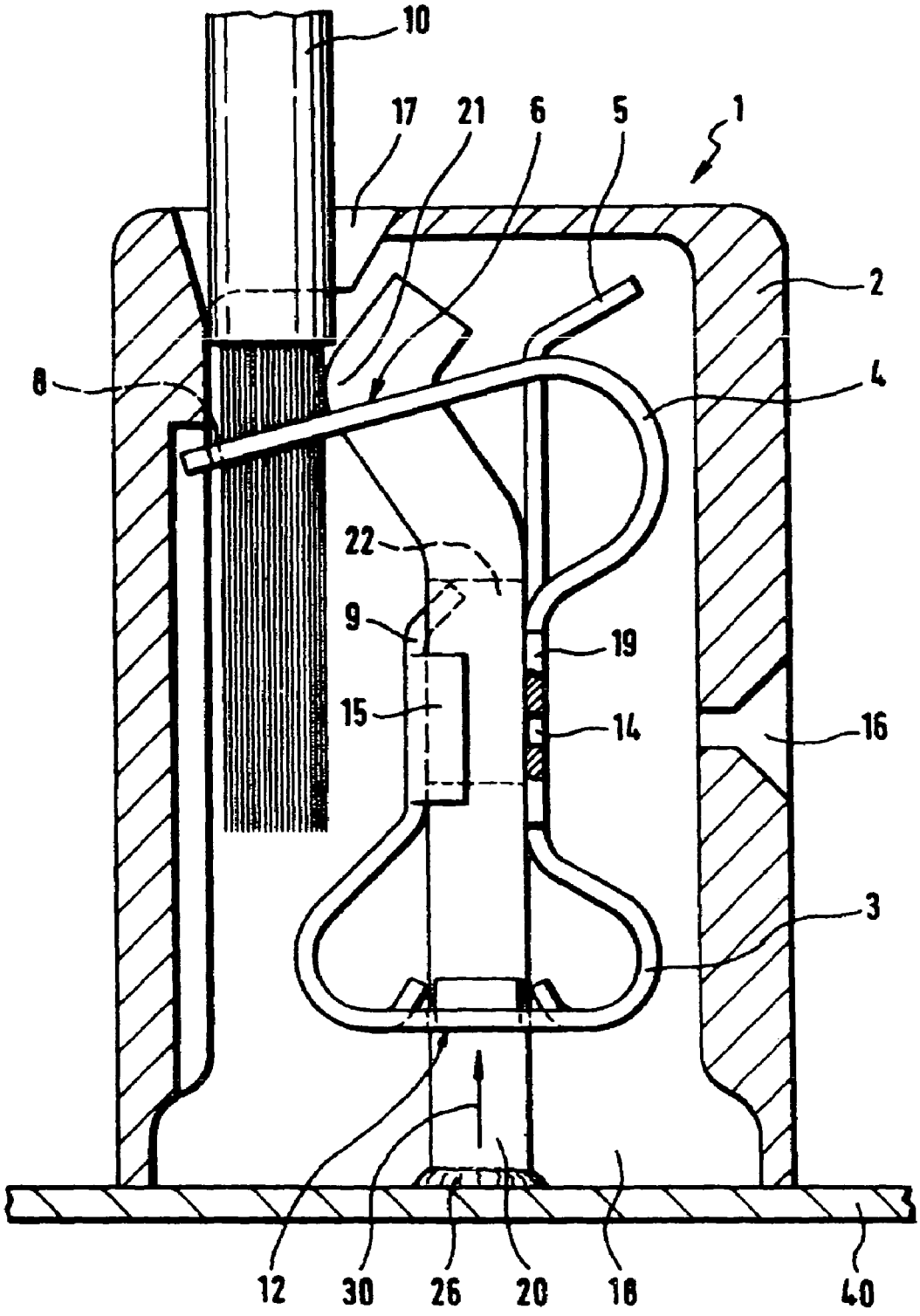
FIG. 4 shows a longitudinal section of the plug according to the invention with electric conductor inserted and holder.

Referring to FIG. 4, a longitudinal section shows how the holder 20 is connected to the electric conductor 10 when the plug according to the invention is completely mounted on the holder 20. Here, the holder is passed through the opening 18 in the housing in the direction indicated by an arrow 30 and through the plug opening 12 of the clamp spring 3. At introduction and in the final state, the holder 20 is passed through the wing elements 15 arranged laterally at the end of the clamp spring. The apex of the crook 21 must point towards clamp edge 8, or electric conductor 10, at introduction of the holder 20 into the plug, in order to make possible an electrical connection between holder 20 and electric conductor 10. Owing to the crook 21, introduction in the opposed direction is not possible, since the bend of the clamp spring 3 would prevent it. But placement of the plug on the holder in another direction is not possible, since the housing opening 18 is rectangular in cross-section, with pairs of side edges having different lengths. When the holder 20 has been introduced all the way into the plug, the bent-over end 9 opposed to the clamp location engages the recess 22 in the holder 20. Thus, the end 9 is so bent away that it points in the direction of the inserted holder. The audible engagement of the bent-over end 9 of the clamp spring 3 assures the user that the electrical connection between the electric conductor 10 and the holder 20 has been made. After complete mounting of the plug 1 on the holder, the holder 20 extends through the clamp opening 6, the holder 20 being arranged between contact leg 5 and electric conductor 10, electric conductor 10 being in contact with the clamp edge 8. The contact leg 5 is so bent in the direction opposed to the clamp location that the holder 20 and the clamp spring are braced against each other in such a way that the electric conductor 10 is clamped [between] the clamp edge 8 and the holder 20, thus forming an electrical connection between the holder 20 and the electric conductor 10.

In a preferred embodiment, by way of example, the inward bent end 9 of the flat spring material scrapes along the projecting crook 21 of the holder 20 when the holder is inserted and removes an insulating varnish in the area where the electrical connection between electric conductor 10 and holder 20 is afterwards to be made. For pulling and releasing the holder 20 from the plug 1, an auxiliary means can be introduced through the lateral opening 16 in the housing 2, for example in the form of a pin. This means is further inserted through the opening 14 of the clamp spring 3 and the opening 22 of the holder 20, and bends the end of the flat spring material of the clamp spring 3 opposed to the clamp edge away from the holder 20 towards the electric conductor 10, so that the bent end 9 disengages from the opening 22 and the plug can be pulled. Thus, the holder moves in the direction opposed to the direction 30 of introduction.

The electrical plug according to the invention should preferably be used to connect ground cables, representing flexible electric conductors, to ground contacts configured as rigid holders on a motor vehicle chassis. Here, the holder is preferably welded to the chassis, as indicated in FIG. 4 by a welding seam 26. The chassis or other support of the holder is marked with reference numeral 40 in FIG. 4.

The holder is preferably provided with a suitable surface having good electrical conductivity and good corrosion protection properties. To ensure good electrical conductivity, in a preferred embodiment by way of example, the holder is provided with a thin protective layer in the crook portion 21, either in the form of injection casting or applied by a dipping process. Alternatively, a waxy medium may be chosen as covering material, liquefying when the lacquer is baked and exposing the bare surface.

To ensure maximum security of the connection between electric conductor 10 and holder 20, the holder and the spring are so tuned to each other that the clamp spring 3 is swung towards the holder 20 under tension on the cable, thereby reducing the cross-section to accommodate the cable. This guarantees a persistent clamping effect.

In another embodiment by way of example, the housing may be so constructed that the electric conductor 10 is introduced perpendicular to the axis of the holder 20, and is so bent on guides arranged in the housing that the end of the electric conductor is arranged parallel to the axis of the holder to form the clamping location. In yet another embodiment of the invention, by way of example, the electrical plug may be of such conformation that several plugs are connected to each other in one housing. Such a multiple plug can then be mounted on holders correspondingly arranged side by side after introduction of the electric conductors. The holder may comprise a constriction arranged at the holder end when using a single or multiple plug.

What is claimed is:

1. An electrical plug adapted to receive an electrical conductor, the plug comprising:

a housing having opposed first and second openings and a recess;

a spring clamp, including:

an opposed pair of wings operable to connect the spring clamp to the housing;

a contact leg extending from the spring clamp to a crook end;

a clamp leg created in a loop shape;

a conductor receiving clamp opening created in the clamp leg through which the crook end extends, the clamp opening including a clamp edge; and a projecting end adjacent the clamp opening; and a stop defining a distal end of the recess, the stop being positioned adjacent the projecting end of the spring clamp and operable to limit a motion of the spring clamp;

wherein a flexible electrical conductor is retainable within the clamp opening between the clamp edge and the contact leg in direct contact with both the clamp edge and the crook end by a springing action of the clamp leg.

2. The plug of claim 1, wherein the first opening is operable to receive the electrical conductor.

3. An electrical plug adapted to receive an electrical conductor, the plug comprising:

a housing having opposed first and second openings, the first opening operable to receive the electrical conductor, and the second opening including a sealing lip operable to contact a chassis member of a vehicle; and a spring clamp, including:

an opposed pair of wings operable to connect the spring clamp to the housing;

a contact leg extending from the spring clamp to a crook end;

a clamp leg created in a loop shape; and a conductor receiving clamp opening created in the clamp leg through which the crook end extends, the clamp opening including a clamp edge;

wherein a flexible electrical conductor is retainable within the clamp opening between the clamp edge and the contact leg in direct contact with both the clamp edge and the crook end by a springing action of the clamp leg.

4. The plug of claim 1, wherein the housing further comprises a substantially rectangular shape.

5. The plug of claim 1, wherein the spring clamp comprises a spring material having a substantially rectangular shaped cross section.

6. An automotive vehicle electrical system adapted to receive an electrical conductor, the system comprising:

a housing having opposed first and second openings;

a flexible device, including:

a first leg extending from the flexible device to an offset section;

a second leg created in a loop shape;

a first clamp opening created in the second leg through which the offset section extends, the first clamp opening including a clamp edge; and a second clamp opening created in the second leg; and a holder connectable to a chassis surface of a vehicle and slidably receivable within the second clamp opening;

wherein the electrical conductor is retainable within the first clamp opening between the clamp edge and the second leg in direct contact with both the clamp edge and the offset section by a springing action of the second leg, the second leg being displaceable when the holder is slidably received within both the second clamp opening and the first clamp opening; and wherein an electrical connection is operably formed by the electrical conductor being engaged between the holder and the clamp edge.

7. The system of claim 6, wherein the spring clamp further comprises a first opposed pair of wings operable to connect the flexible device to the housing.

8. The system of claim 7, wherein the flexible device further comprises a second opposed pair of wings operable to engage with the holder.

9. The system of claim 8, wherein the flexible device further comprises a bent-over end oppositely located from the first clamp opening and adjacent to the second opposed pair of wings.

10. The system of claim 9, wherein the holder further comprises an aperture adapted to receive the bent-over end of the flexible device in a holder engaged position.

11. The system of claim 10, wherein the housing further comprises an aperture adapted to receive a release tool operable to disengage the holder from the holder engaged position.

12. The system of claim 11, wherein the flexible device further comprises a clamp aperture aligned with the housing aperture to receive the release tool.

13. The system of claim 6, wherein the holder comprises a bend extending through the first clamp opening, the bend operable to engage the electrical conductor.

14. An electrical plug system adaptable to receive an electric conductor, the system comprising:

a housing;

a holder having an end piece; and a spring clamp operable to connect the electric conductor to the end piece of the holder, the spring clamp including:

a contact leg and a clamp leg, the clamp leg being bent closed in the manner of a loop onto an end of the contact leg;

a clamp opening through which the end of the contact leg protrudes; and a clamp edge of the clamp opening located opposed to the clamp leg and operably forming a temporary clamp location together with the contact leg, in which the electric conductor passed through the clamp opening is clamped before the plug is mounted on the holder;

wherein after the plug is mounted on the holder, the holder extends through the clamp opening between the contact leg and the electric conductor, and the holder and the clamp spring are so braced against one another that the electric conductor is clamped between the clamp edge and the end piece of the holder, operably forming an electrical connection between the holder and the electric conductor.

15. The system of claim 14, wherein the contact leg comprises a crook operably directed towards the clamp edge of the clamp opening.

16. The system of claim 14, wherein an end of the spring clamp opposed to the clamp location includes a bend directed towards the holder.

17. The system of claim 16, wherein the holder further comprises a recess, wherein after mounting of the plug on the holder, the bend of the spring clamp operably catches in and engages the recess.

18. The system of claim 14, wherein the spring clamp further comprises a plug opening through which the holder is passed after mounting of the plug thereon.

19. The system of claim 14, wherein the spring clamp further comprises a release opening through which an auxiliary device serving to release the plug is insertable.

20. The system of claim 14, wherein the spring clamp further comprises at least one positioning wing element arranged at an end of the spring clamp opposed to the clamp location, the positioning wing operable to position the holder with respect to the spring clamp.

21. The system of claim 14, further comprising:

a recess of the housing; and at least one wing element of the spring clamp;

wherein the at least one wing element is accommodated in the recess of the housing to operably fix the spring clamp in the housing.

22. The system of claim 14, wherein the housing further comprises:

a hollow rectangular shape having an interior wherein the clamp spring is arranged;

a first end having an opening operable to receive the electric conductor; and a second end having an opening operable to receive the holder.

23. The system of claim 22, further comprising a sealing lip arranged adjacent to at least one of the openings of the housing.

24. The system of claim 14, wherein the holder further comprises:

a pin shape including a crook, an apex of the crook pointing toward the clamp edge of the clamp leg; and a strip material of substantially rectangular cross-section.

25. The system of claim 14, further comprising a weld joint operably joining the holder to a support.

26. A method for making an electrical connection between an electrical conductor, an electrical plug and a holder mounted to a vehicle chassis, the electrical plug including a housing and a spring clamp having a contact leg, a clamp leg and a clamp opening, the method comprising:

temporarily clamping the electrical conductor between the clamp edge and the contact leg;

mounting the plug on the holder such that the holder extends through the clamp opening between the contact leg and the electrical conductor to operably displace the contact leg; and biasing the holder and the spring clamp against each other such that the electrical conductor is clamped between the clamp edge and the holder, operably forming an electrical connection between the holder and the electrical conductor.

27. The method of claim 26, further comprising passing the electrical conductor through an opening in the housing and through the clamp opening of the clamp leg before the mounting step.

28. The method of claim 26, further comprising creating a mass contact between an electrically operated motor vehicle part and the vehicle chassis.

29. The method of claim 26, further comprising:

inserting an auxiliary device through each of a release opening in the housing, a release opening of the spring clamp, and a recess in the holder;

displacing an end of the spring clamp away from the holder with the auxiliary device; and retracting the plug from the holder.

30. The method of claim 26, further comprising shaping the clamp leg in a loop shape.

31. The method of claim 26, further comprising engaging a tongue of the clamp leg in a recess of the holder during the mounting step.

32. The method of claim 26, further comprising aligning an opposed pair of wings of the clamp leg partially about the holder during the mounting step.

33. The method of claim 26, further comprising creating a stop in the housing positioned adjacent a distal end of the spring clamp to control a displacement of the spring clamp.

* * * * *